US006328933B1

(12) United States Patent
Labriola et al.

(10) Patent No.: US 6,328,933 B1
(45) Date of Patent: Dec. 11, 2001

(54) DOUBLE DENSITY PIPETTE TIP STORAGE RACK

(75) Inventors: Anthony M Labriola, Woburn; Joseph C Wall, Southborough, both of MA (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/527,545

(22) Filed: Mar. 16, 2000

(51) Int. Cl.[7] ..... B01L 3/02; B01L 3/00; B01L 9/00; B65D 1/34; A47B 73/00

(52) U.S. Cl. ..... 422/104; 422/99; 422/100; 206/562; 206/558; 211/74; 211/85.13

(58) Field of Search ..... 422/99, 100, 104; 206/562, 558; 211/74, 85.13

(56) References Cited

U.S. PATENT DOCUMENTS

| | | | | |
|---|---|---|---|---|
| 5,057,282 | * | 10/1991 | Linder | 422/104 |
| 5,318,753 | | 6/1994 | Honda | 422/104 |
| 5,324,482 | | 6/1994 | Scaramella et al. | 422/100 |
| 5,392,914 | | 2/1995 | Lemieux et al. | 206/499 |
| 5,441,702 | * | 8/1995 | Lemieux et al. | 422/100 |
| 5,445,270 | * | 8/1995 | Dratz | 206/443 |
| 5,470,538 | * | 11/1995 | Lind | 422/104 |
| 5,487,997 | * | 1/1996 | Stolp | 436/54 |
| 5,612,000 | | 3/1997 | Lemieux | 422/100 |
| 5,622,676 | | 4/1997 | Lind | 422/104 |
| 5,630,988 | | 5/1997 | Stolp | 422/100 |
| 5,642,816 | * | 7/1997 | Kelly et al. | 211/60.1 |
| 5,779,984 | * | 7/1998 | Kelly et al. | 422/104 |
| 5,948,362 | * | 9/1999 | Steinbrenner et al. | 422/100 |
| 6,007,779 | * | 12/1999 | Lemieux et al. | 422/100 |
| 6,098,819 | | 8/2000 | Link | 211/85.13 |
| 6,221,317 | | 4/2001 | Carl | 422/104 |

* cited by examiner

*Primary Examiner*—Jill Warden
*Assistant Examiner*—Brian R. Gordon
(74) *Attorney, Agent, or Firm*—Thomas R. Beall

(57) ABSTRACT

A reusable pipette-tip holder that doubles the density of the number of pipette tips able to be stored within a single container, while conserving the total amount of material, packaging and storage space. The invention creates a rigid box by the joining, bottom to bottom, of two pipette-racks each having a standard matrix of pipette-receiving holes. The new design permits pipettes to be inserted from both the top and bottom of the box, because the centerline spacing of the rows of pipette-receiving holes on the top and bottom surfaces is offset with respect to each other. Rows of pipette tips from one side of the container nest between the free space in adjacent rows of tips inserted from the other side of the container.

3 Claims, 2 Drawing Sheets

DOUBLE DENSITY PIPETTE TIP STORAGE RACK

BACKGROUND

The use of pipette devices for the transfer and dispensing of precise quantities of fluids in analysis is well known. Likewise, disposable plastic tips used with pipetting devices have been commercially available for decades. These tips are used with pipetting devices that may use 1, 8, 12, or 96 tips simultaneously, and are usually packed vertically in a pipette tip rack.

The function of a pipette tip rack is to organize disposable pipette tips in a manner for convenient placement on a pipette. A pipette tip rack is usually a plastic box that has 96 holes into which the pipette tips are placed. The 96 holes are typically arranged in an eight by twelve array that are spaced 9 mm apart on their centerlines. Generally, such racks comprise a rigid base with vertical sides joined at contiguous edges and horizontally supporting a rigid pipette tip organizing tray having an array of pipette receiving holes extending through the top surface of the tray. Alternatively, pipette tip racks comprise a rigid tray which includes support sides and a flat top surface containing an array of holes for receiving and supporting an array of pipette tips. In either embodiment, the pipette tips are organized and held vertically by the array of holes for ease of access. Either a technician or a mechanical pipetting device simply places a pipette over the rack and lowers the distal end of the pipette into a proximal or upper end of a vertically oriented pipette tip and presses down to affix the tip which is held to the pipette by friction.

After all the tips are used the customary practice has been to either reload the rack by hand with pipette tips purchased in bulk or dispose of the rack. Presently, these two customary practices each present significant disadvantages. The disadvantage of reloading the tips into the rack by hand is that it is a very time consuming operation for lab workers who are generally over qualified for such repetitious work, as well as, the pipette tips may become contaminated by the manual handling. The disadvantage of disposing of the rack is that it ordinarily consists of three molded parts that still retain some value, namely, the rack, itself, a cover to enclose the tips, and a baseplate to enclose and seal the bottom of the rack. Since tips are often used in large quantities, disposing of bulky racks is wasteful and environmentally harmful. As a result, manufacturers are paying more attention to the issues that effect cost and storage space requirements, and the environment. This attention, in turn, has generated a desire to eliminate or reduce the amount of packaging required to ship and store products. These concerns have driven the need to develop a new design for a pipette tip rack.

SUMMARY OF THE INVENTION

The new design creates a reusable pipette-tip rack, conceptually made by the joining of two standard 96 hole-matrix pipette-tip racks, base-to-base, to form a rigid box with a central cavity. More significantly, the new design doubles the density of the number of pipette tips contained in a single box. Pipette tips are arranged in the typical eight by twelve array, however, the tips are loaded into the package from both the top and bottom of the box. By off setting the centerline spacing of the rows of holes on both top and bottom horizontal surfaces from one side of the box to the other side by 4.5 mm, the new rack is able to accommodate twice the number of pipette tips over other pipette tip rack that are currently on the market. The new design interlocks or nests the rows of tips from one side of the box between the free space in adjacent rows of tips on the other side of the box. Thus, the proposed pipette tip rack conserves both the amount of space and material needed. The new packaging design reduces the amount of packaging required for shipping and storing products with the use of the least amount of space, while increasing the number of pipettes available for use within a single package.

DETAILED DESCRIPTION OF THE INVENTION

Figure 1:
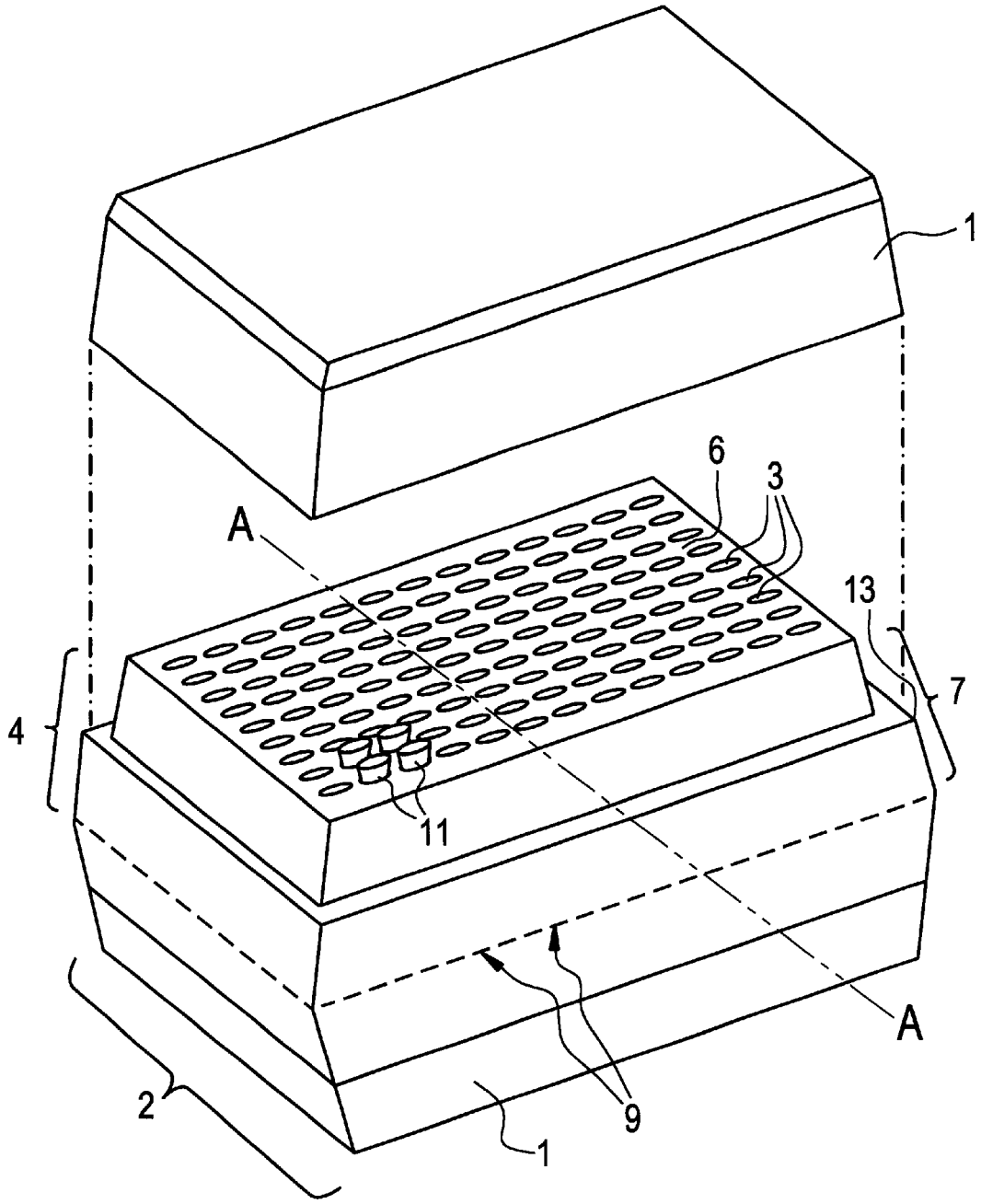
FIG. 1. Three-quarter view of the invention, with the top cover removed, showing the arrangement of the rows of holes to hold the pipette tips in the upper tray.

FIG. 1 shows a perspective view of the new, reusable, pipette-tip rack design. The invention comprises what can be described conceptually as two identical pipette-tip organizing trays with rigid, clear plastic covers 1 that fit snugly over each tray. Each tray has an array of pipette tip receiving holes 3 extending through a rigid, horizontal surface 6, and rigid, vertically extending side wall members 7 joined at contiguous edges with the horizontal surface. In mental perception, to form the proposed pipette-tip rack, one of the two trays 1 is turned upside-down the lower tray 2 and joined to the other tray the upper tray 4 along the terminal edge 9 of the vertically extending side members at the respective bases of the two trays 2, 4.

One method of manufacture is to mold the upper and lower trays together as a single piece. A more preferred process of fabrication is to make the rack from two separate pieces rather than one, so as to conserve the amount of plastic (e.g., polystyrene or polypropylene) used. The two separately molded pieces would be fused together with ultrasonic bonding, snap-fit or any other conventional method. The resulting article is a rigid, plastic box having a central cavity that is accessed through rows of pipette-tip receiving holes from both the upper 6 and lower 8 horizontal surfaces. The upper and lower horizontal surfaces 6, 8 are parallel with each other.

Figure 2:
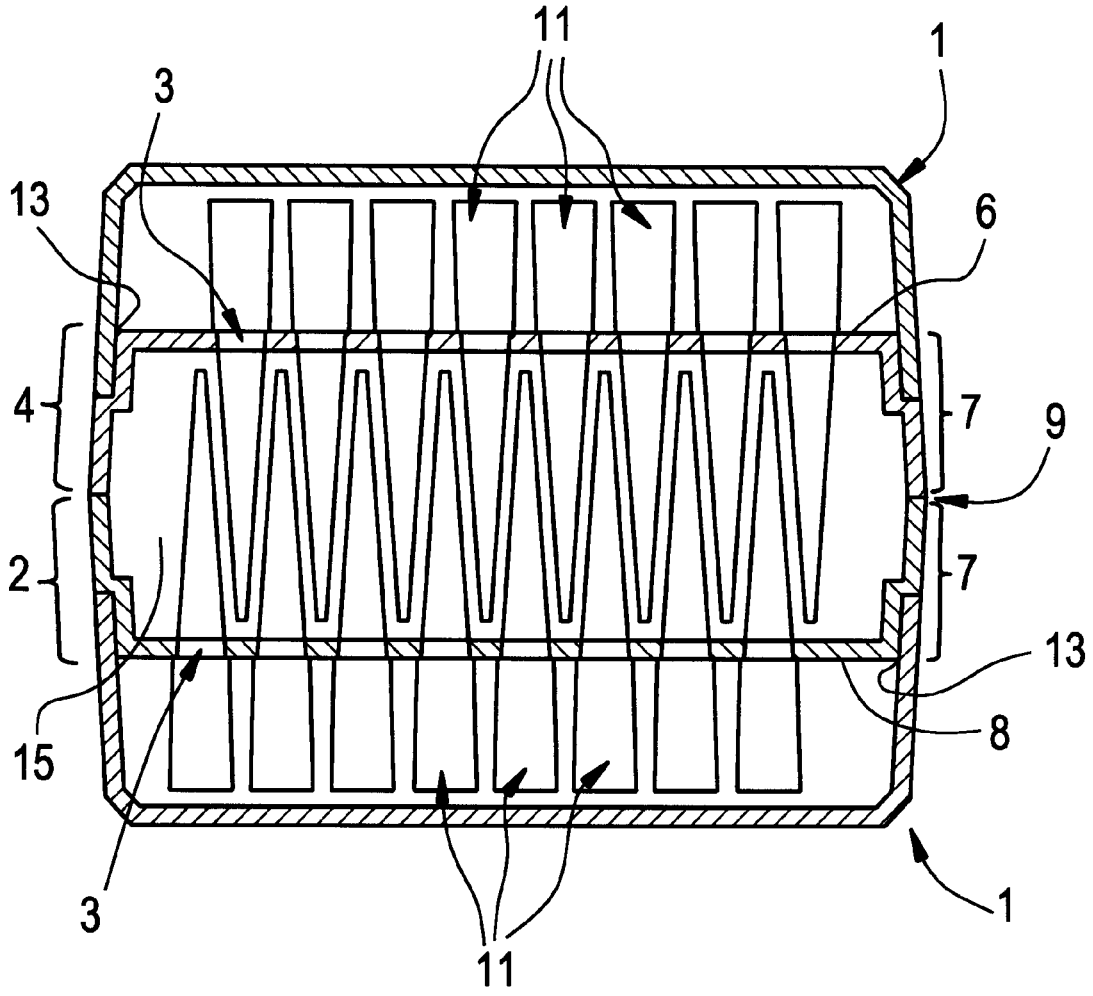
FIG. 2. Cross sectional view along the line A—A.

Existing standard pipette-tip storage racks have a footprint of 96 pipette tip receiving holes. These holes are typically arranged in an eight by twelve array, and are spaced 9 mm apart along their centerlines. For the new rack to hold twice the number of pipette-tip 11 as existing racks on the market, the centerline of each of the rows of pipette-tip receiving holes 3 is offset to one side by 4.5 mm. Without increasing substantially the total height or vertical dimensions of the rack, the off-set allows two arrays of pipette tips 11 to be loaded into the same rack from opposing sides. The off-set permits pipette-tips 11 to nest in the empty space between adjacent rows of tips inserted from the opposite side, as shown in FIG. 2. The pipette-tip receiving holes 3 in the upper 4 and lower trays 2 are not directly in line with one another, whereby the tips 11 from opposing sides will not contact each other head-on.

Each of the upper 4 and lower 2 trays has a cover 1 that can support the entire weight of the pipette-tip rack when the rack is inverted top-side down and bottom-side up. The covers 1 for the upper and lower trays can be fabricated either as hinged to the rack or completely removeable. In a preferred embodiment, the new rack design can store up to 192 pipette tips.

The advantage of the new design is that it decreases required storage space and material costs, while doubling the density of pipette tips packed in each package. The new design is also reusable because it is reloadable. Although a preferred embodiment of the invention has been disclosed in detail, those skilled in the art can appreciate that variations or modifications may be made thereof and other embodiments may be perceived without departing from the scope of the invention, as defined by the appended claims and their equivalents.

We claim:

1. A reusable pipette-tip rack comprising:

upper and lower pipette tip organizing trays, each having an array of pipette tip receiving holes extending through a rigid, horizontal surface of said trays, and rigid, vertically extending side members joined at contiguous edges with said horizontal surface;

said upper and lower trays are joined along a terminal edge, opposite said contiguous edges, of said vertical side members, and molded together to form a closed, rigid box with a central cavity, and said horizontal surfaces of said upper and lower trays and said vertically extending side members define and form the perimeter of the central cavity;

wherein pipette tips are vertically loaded into said central cavity by inserting from both upper and lower trays of said box;

and wherein a centerline of each row of pipette-tip receiving holes in each said array in said horizontal surface of said trays is off-set sideways from existing, standard spacing between rows of holes, whereby rows of pipette tips extending downward into said central cavity from said upper pipette tip organizing tray are nested in a free space between adjacent rows of tips extending upward into said central cavity from opposing said lower tray;

and each of said upper and lower trays having a cover that can support the entire weight of the pipette-tip rack when said rack is inverted.

2. The reusable pipette-tip rack in claim 1, wherein said upper and lower pipette tip organizing trays are identical and have each an eight by twelve array of 96 pipette tip receiving holes.

3. The reusable pipette-tip rack of claim 1 wherein said off-set of said centerline of each row of said pipette-tip receiving holes in said horizontal surface of said trays is 4.5 mm.

* * * * *